US006018330A

United States Patent [19]

Yamamoto et al.

[11] Patent Number: 6,018,330

[45] Date of Patent: Jan. 25, 2000

[54] LIQUID CRYSTAL DISPLAY APPARATUS

[75] Inventors: Takashi Yamamoto, Yamato; Koichi Sono, Hiratsuka; Tomoyuki Ohno, Atsugi, all of Japan

[73] Assignee: Canon Kabushiki Kaisha, Tokyo, Japan

[21] Appl. No.: 08/637,408

[22] Filed: Apr. 25, 1996

[30] Foreign Application Priority Data

Apr. 28, 1995 [JP] Japan ..... 7-127459

[51] Int. Cl.[7] ..... G09G 3/36

[52] U.S. Cl. ..... 345/99; 345/94

[58] Field of Search ..... 345/94, 97, 99, 345/100, 87

[56] References Cited

U.S. PATENT DOCUMENTS

| | | | |
|---|---|---|---|
| 4,367,924 | 1/1983 | Clark et al. | 349/37 |
| 4,938,574 | 7/1990 | Kaneko et al. | 345/97 |
| 5,267,065 | 11/1993 | Taniguchi et al. | 345/97 |

FOREIGN PATENT DOCUMENTS

| | | |
|---|---|---|
| 56-107216 | 3/1981 | Japan . |
| 2-281233 | 11/1990 | Japan . |

*Primary Examiner*—Matthew Luu

*Attorney, Agent, or Firm*—Fitzpatrick, Cella, Harper & Scinto

[57] ABSTRACT

A liquid crystal display apparatus has a liquid crystal display device including a first substrate having scanning electrodes, a second substrate having information electrodes, the scanning electrodes and the information electrodes forming a matrix electrode structure, and a liquid crystal interposed between the first and second substrates, a clock generator circuit for generating clock pulses, scanning electrode drivers for forming a scanning signal and applying the scanning signal to one of the scanning electrodes each time a clock pulse is supplied from the clock generator circuit, and information electrode drivers for forming an information signal and applying the information signal to the information electrodes each time a clock pulse is supplied from the clock generator circuit. The width δt0 of at least one of a plurality of clock pulses SCLK supplied from the clock generator circuit in one horizontal scanning period T is different from the width δt1 of the other clock pulses.

8 Claims, 9 Drawing Sheets

| | | | | |
|---|---|---|---|---|
| CWFD0 | 0 | 0 | 1 | 1 |
| CWFD1 | 0 | 1 | 0 | 1 |
| OUTPUT | VC | V1 | V2 | V5 |

| | | | | |
|---|---|---|---|---|
| CWFD2 | 0 | 0 | 1 | 1 |
| CWFD3 | 0 | 1 | 0 | 1 |
| OUTPUT | VC | V1 | V2 | V5 |

| | | | | |
|---|---|---|---|---|
| SWFD0 | 0 | 0 | 1 | 1 |
| SWFD1 | 0 | 1 | 0 | 1 |
| OUTPUT | VC | V3 | V4 | Z |

| | | | | |
|---|---|---|---|---|
| SWFD2 | 0 | 0 | 1 | 1 |
| SWFD3 | 0 | 1 | 0 | 1 |
| OUTPUT | VC | V3 | V4 | Z |

LIQUID CRYSTAL DISPLAY APPARATUS

BACKGROUND OF THE INVENTION

1. Field of the Invention

The present invention relates generally to liquid crystal display apparatuses and, more particularly, to a liquid crystal display apparatus which performs matrix driving by utilizing bistable conditions of a liquid crystal, particularly a chiral smectic liquid crystal or a ferroelectric liquid crystal.

2. Description of the Related Art

A kind of Liquid crystal display device is well known in which a liquid crystal mixture is packed between an electrode substrate having scanning electrodes and another electrode substrate having information electrodes, the scanning electrodes and the information electrode forming a matrix electrode structure, and in which a multiplicity of pixels are formed to display image information.

There are good hopes that display devices using chiral smectic liquid crystal, particularly a ferroelectric liquid crystal having bistability and high-speed response to an electric field will be put to practical use as a high-speed memory type display device. For example, such devices are disclosed in Japanese Patent Laid-Open Publication No. 107216/1981 and other documents. Many methods for driving such devices in a matrix drive manner have also been proposed. For example, practical drive methods are disclosed in Japanese Patent Laid-Open Publication No. 281233/1990 and other documents.

The conventional display devices using a ferroelectric liquid crystal, however, have a drawback in that during a long time period of standing in one stable state the threshold characteristic of the display device is changed by interaction at the interface between the substrate and the liquid crystal layer. To solve this problem, a drive method has been proposed which sets a rest period during which application of information signals to information electrodes is stopped. FIG. 1 shows waveforms of drive signals in accordance with this method. The waveforms shown in FIG. 1 represent waveforms C and D of image signals applied to information electrodes to display light and dark, a selection pulse having a width of ΔT, auxiliary pulses having a width of ½ΔT provided before and after the selection pulse and a rest period having a width of ½ΔT and provided to separate auxiliary pulses with respect to time.

FIG. 2 is a graph showing the relationship between the rest period of the drive signals and a drive margin measured as a range in which the liquid crystal display device can suitably display information at a temperature of 10° C., for example, when the drive conditions shown in FIG. 1 are V1=14.3 V, V2=14.3 V, V3=5.7 V, V4=5.7 V, V5=6.4 V, and VC=0 V. For improvement in the quality of an image displayed on the display device, a higher frame frequency is preferred. Accordingly, it is preferable to shorten the rest period. Considering both the drive margin and the frame frequency, it is suitable to set the rest period to a length about ½ΔT. However, the optimal value of the rest period is between ½ΔT and ΔT.

FIG. 3 shows the drive waveforms when the rest period is 0.6 ΔT. In this case, since the rest period is set to 0.6 ΔT, one horizontal scanning period is formed of twenty six intervals and the information signals have ΔT set as ten of these intervals and the rest period set as six of these intervals. If the rest period is selected so as to balance the drive margin and the frame frequency while considering the desired drive margin as described above, the number of intervals forming the drive waveform is considerably increased. Therefore, a need arises to operate the drive circuit at a higher speed and the rest period cannot be selected freely.

SUMMARY OF THE INVENTION

In view of the above-described problem of the related art, an object of the present invention is to provide liquid crystal display apparatus in which an optimal rest period can be selected without requiring any increase in the operating speed of the drive circuit, and in which a drive condition for making good display can easily be set thereby.

To achieve this object, according to one aspect of the present invention, there is provided a liquid crystal display apparatus comprising a liquid crystal display device including a first substrate and a second substrate opposed to each other, the first substrate having scanning electrodes, the second substrate having information electrodes, the scanning electrodes and the information electrodes forming a matrix electrode structure, and a liquid crystal interposed between the first and second substrates, clock generation means for generating clock pulses, scanning electrode drive means for forming a scanning signal and applying the scanning signal to one of the scanning electrodes each time a clock pulse is supplied from the clock generation means, and information electrode drive means for forming an information signal and applying the information signal to the information electrodes each time a clock pulse is supplied from the clock generation means, wherein at least one of a plurality of clock pulses supplied from the clock generation means in one horizontal scanning period differs in width from the others.

Preferably, the clock generation means comprises binary signal output means, counter means for counting primary clocks supplied, hold means for holding a given reference value, and comparison means for comparing a count value of the counter means and the reference value held by the hold means. When the reference value and the count value coincide with each other, an output value of the output means is inverted to form one of the clock pulses and a new reference value is set in the hold means.

These and other objects, advantages and features of the present invention will become apparent from the following detailed description of a preferred embodiment of the invention with reference to the attached drawings.

BRIEF DESCRIPTION OF THE DRAWINGS

FIGS. 8(*a*)–8(*d*) constitute a diagram showing the relationship between drive waveform data and output voltages in the scanning electrode driver and the information electrode driver in the display device of FIG. 4;

DESCRIPTION OF THE PREFERRED EMBODIMENT

According to the present invention, the length of a particular section of the drive waveform can be changed substantially continuously by freely changing the width of at least one of clock pulses supplied during one horizontal scanning period. Therefore, with respect to the drive waveform requiring a rest period, an optimal rest period can be selected, for example, according to variation in temperature at the time of driving a liquid crystal without increasing the operating speed of the circuit, thereby setting the desired drive margin.

An embodiment of the present invention will be described below with reference to the accompanying drawings.

Figure 1:
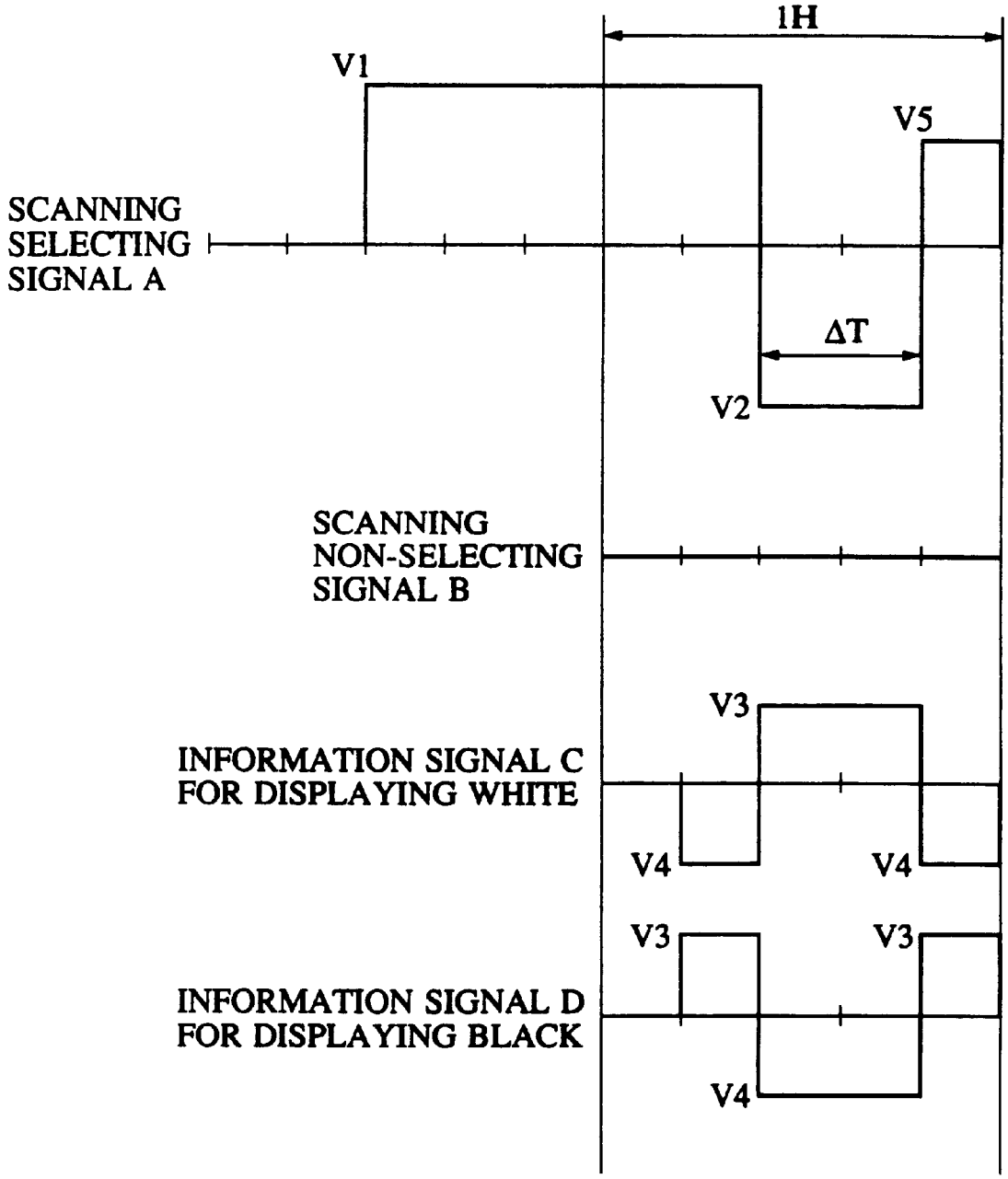
FIG. 1 PRIOR ART
FIG. 1 is a diagram showing drive waveforms in a liquid crystal display apparatus.
Figure 2:
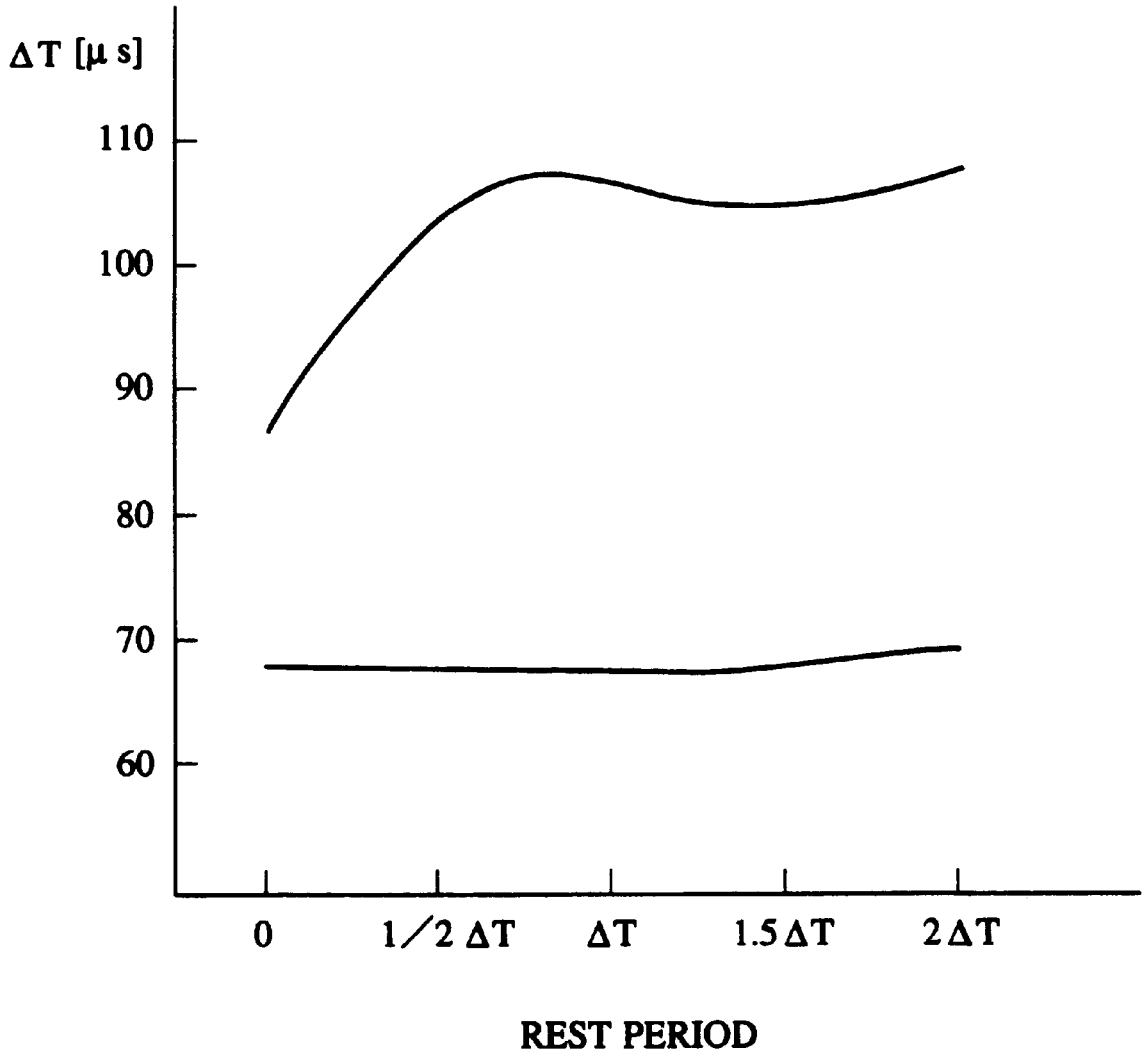
FIG. 2 PRIOR ART
FIG. 2 is a diagram showing the relationship between the rest period and the drive margin of the drive signal in the apparatus shown in FIG. 1.
Figure 3:
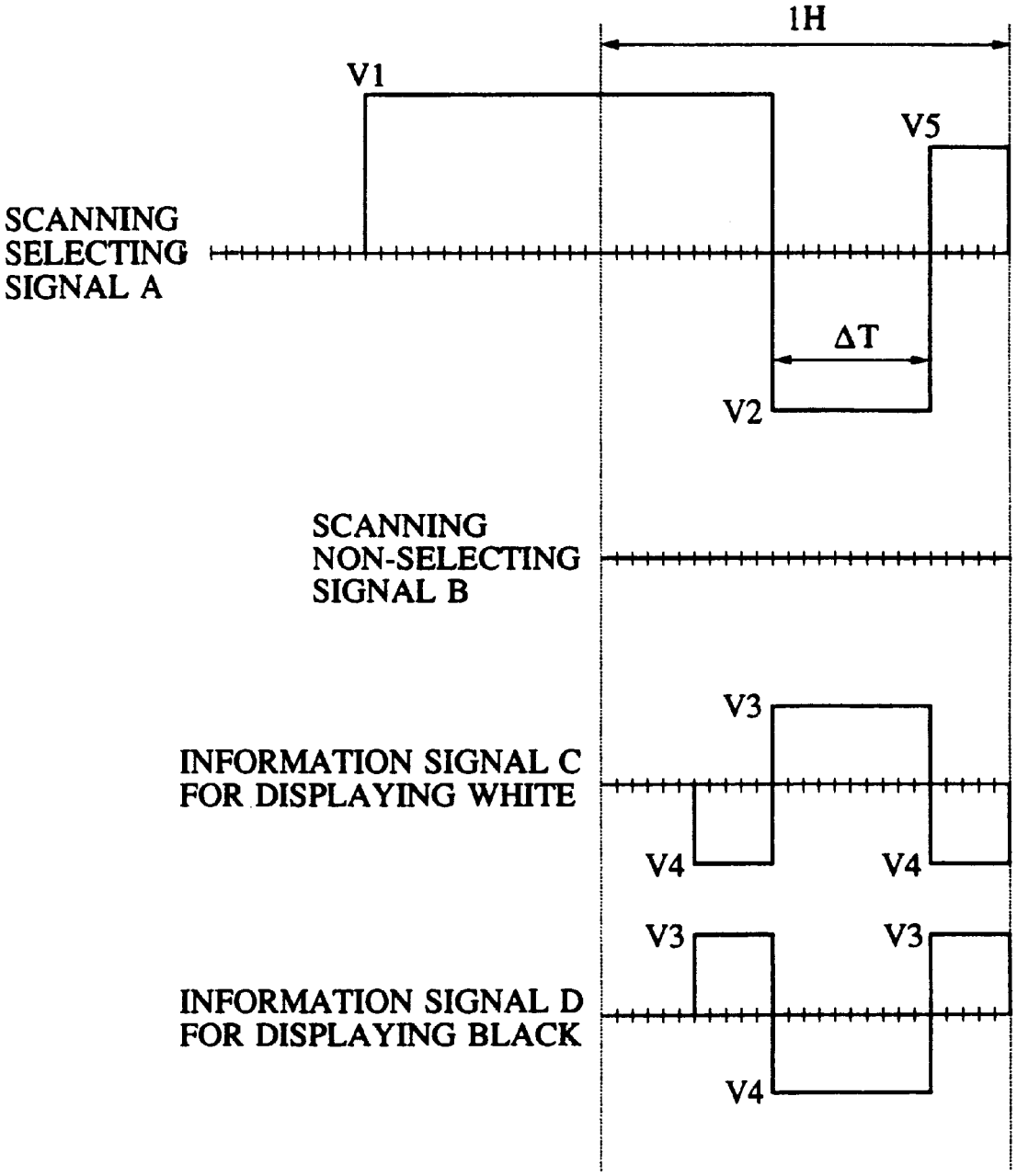
FIG. 3 PRIOR ART
FIG. 3 is a diagram showing another example of the drive signal waveforms in a liquid crystal display apparatus.
Figure 4:
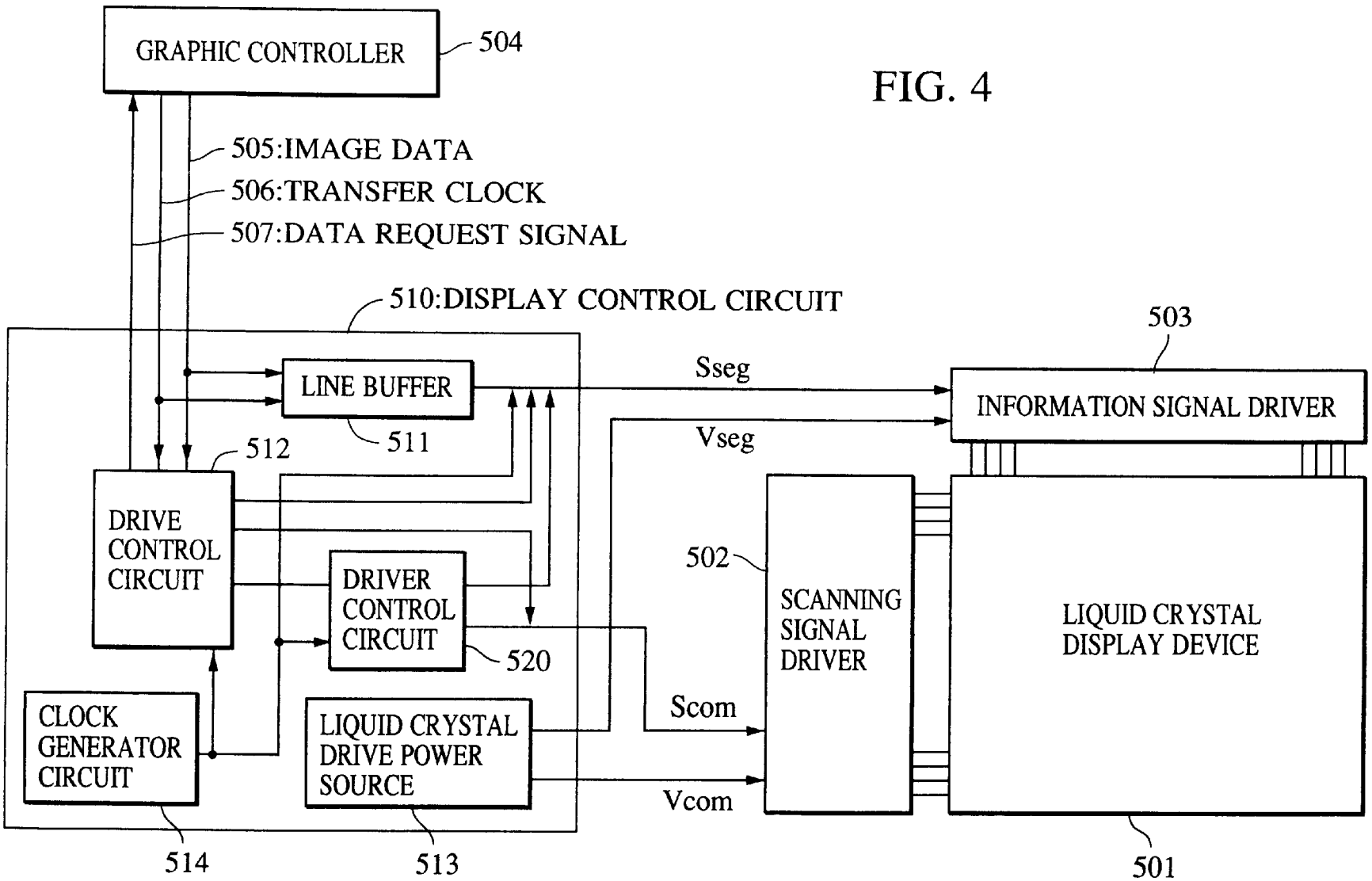
FIG. 4 is a block diagram of an embodiment of a liquid crystal display apparatus in accordance with the present invention.

FIG. 4 is a block diagram of an embodiment of a liquid crystal display apparatus in accordance with the present invention. A graphic controller 504 forms image data 505 displayed by a liquid crystal display device 501. The graphic controller 504 transmits image data 505 to a line buffer 511 and to a drive control circuit 512 in synchronization with transfer clock 506 when it receives a data request signal 507 from a display control circuit 510. Signals Scom and Sseg are transmitted from the display control circuit 510 to a scanning signal driver 502 and to an information signal driver 503. A liquid crystal drive power source 513 has power supplys Vcom and Vseg for the scanning signal driver 502 and the information signal driver 503. The scanning signal driver 502 and the information signal driver 503 supplied with these signals and the power from these power supplys drive the liquid crystal display device 501 to display the image data.

Figure 5:
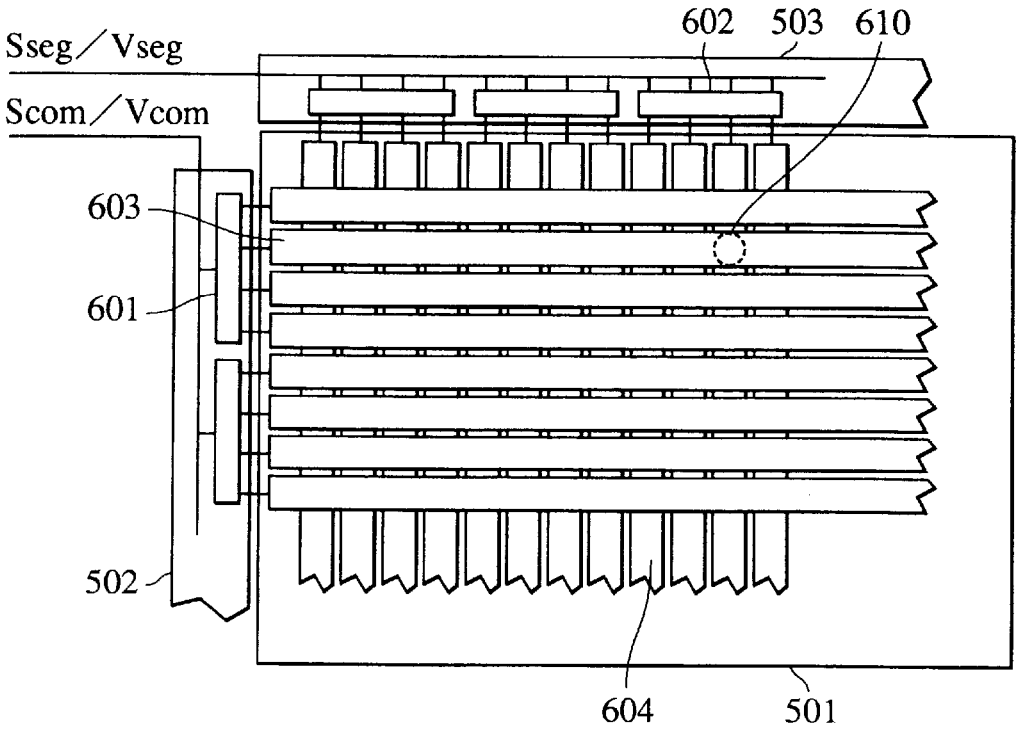
FIG. 5 is a schematic diagram of a liquid crystal display device shown in FIG. 4.

FIG. 5 is a schematic diagram showing an essential portion of the liquid crystal display device 501. The liquid crystal display device 501 has a liquid crystal (not shown) interposed between scanning electrodes 603 and information electrodes 604 provided on a pair of glass substrates (not shown) opposed to each other. Pixels 610 are formed at points of intersection of the scanning electrodes 603 and the information electrodes 604. The scanning signal driver 502 has scanning electrode drivers 601 for driving the scanning electrodes while the information signal driver 502 has information electrode drivers 602 for driving the information electrodes.

Figure 6:
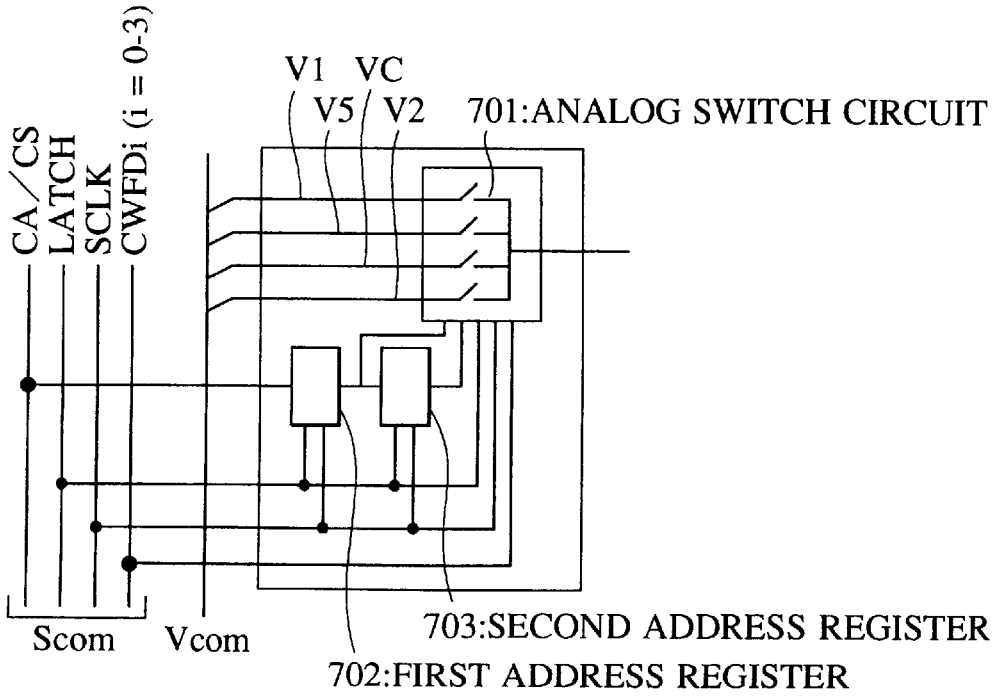
FIG. 6 is a block diagram showing the configuration of a scanning electrode driver in the display device of FIG. 4.

FIG. 6 is a diagram showing the construction of each scanning electrode driver 601. An analog switch circuit 701 shown in FIG. 6 selects one of liquid crystal power supply voltages V1, V5, VC, and V2 supplied by liquid crystal power supply Vcom according to drive waveform data CWFDi (i=0 to 3). Ordinarily, a plurality of analog switch circuits 701 are laid in one scanning electrode driver 601 to drive a plurality of scanning electrodes. Each scanning electrode driver 601 also has a first address register 102 and a second address register driver 703. The address register 702 of the scanning electrode driver 601 selected by a chip selecting signal CS transfers an address that it has held to the address register 703 by a rise of a signal SCLK during the period of assertion of a signal LATCH. Simultaneously, the address register 702 latches scanning address CA. Each time signal SCLK rises, one of the plurality of analog switch circuits 701 designated by the address register 702 selects and outputs the liquid crystal power supply voltage according to drive waveform data CWFD0 and CWED1. Also, each time signal SCLK rises, the analog switch circuit 701 designated by the address register 703 selects and outputs the liquid crystal power supply voltage according to drive waveform data CWFD2 and CWFD3.

Figures 7, 8A, 8B, 8C, 8D:
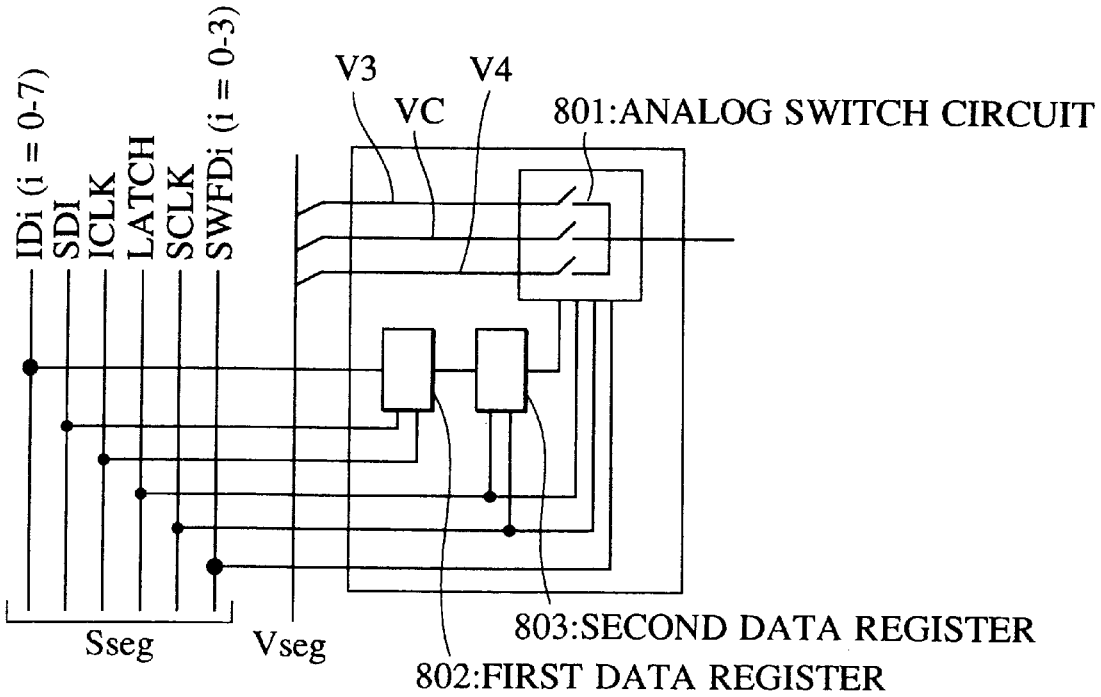
FIG. 7 is a block diagram showing the configuration of an information electrode driver in the display device of FIG. 4.

FIG. 7 is a diagram showing the construction of each information electrode driver 602. An analog switch circuit 801 shown in FIG. 7 selects one of liquid crystal power supply voltages V3, VC, and V4 supplied by liquid crystal power supply Vseg according to drive waveform data SWFDi (i=0 to 3). Ordinarily, a plurality of analog switch circuits 801 are laid in one information electrode driver 602 to drive a plurality of information electrodes. Each information electrode driver 602 also has a first data register 802 and a second data register driver 803. The data register 802 stores image data IDi (i=0 to 7) transmitted to it in synchronization with a data transfer sync signal ICLK when it receives a data transfer start signal SDI. Also, the data register 802 transfers data that it has held to the data register 803 at the time of a rise of signal SCLK during the period of assertion of signal LATCH. Each time signal SCLK rises, the plurality of analog switch circuits 801 select and output the liquid crystal power supply voltage according to drive waveform data SWFD0 and SWFD1 if the corresponding data in the data register 803 is 1 designating a white state or according to drive waveform data SWFD2 and SWFD3 if the corresponding data is 0 designating a black state.

FIG. 8 shows the relationship between drive waveform data CWFDi (i=0 to 3) and SWFDi (i=0 to 3) and the selected liquid crystal power supply voltage.

Figure 9:
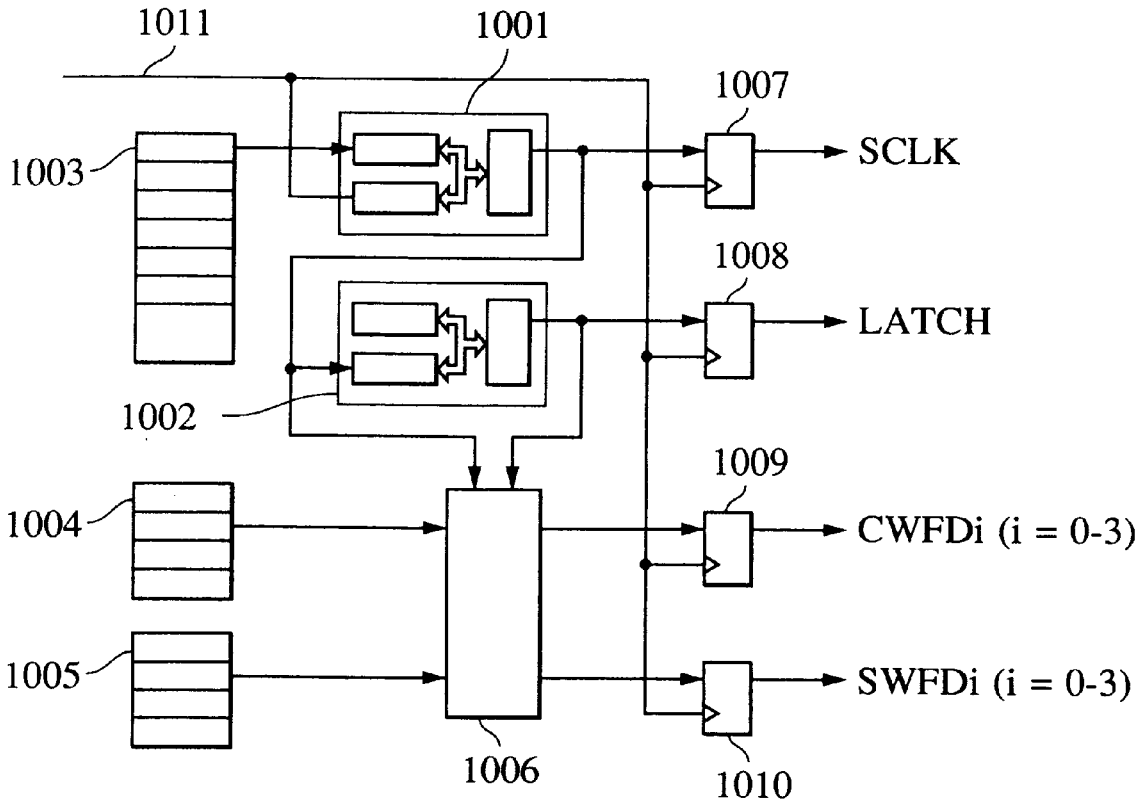
FIG. 9 is a block diagram showing the configuration of a driver control circuit provided in the display apparatus shown in FIG. 4.

FIG. 9 is a diagram showing the configuration of the driver control circuit 520. A variable width clock generator circuit 1001 shown in FIG. 9 counts cycles of an original clock signal 1011 distributed from a clock generator circuit 514. The variable width clock generator circuit 1001 inverts its output SCLK when the counted value becomes equal to a value (reference value) set in its internal comparison register. Simultaneously, the variable width clock generator circuit 1001 sets in the comparison register a subsequent value selected from values previously stored in a clock width register 1003, and clears the counter. Preferably, according to the present invention, the width of the output SCLK is changed according to an environmental condition such as drive temperature, for example, by variously changing the values (reference values) stored in the clock width register 1003 on the basis of a temperature compensation table. The read position of the clock width register 1003 is reset to the initial position in the period of assertion of signal LATCH. Signal SCLK is synchronized with the clock signal by a latch circuit 1007.

Figure 10:
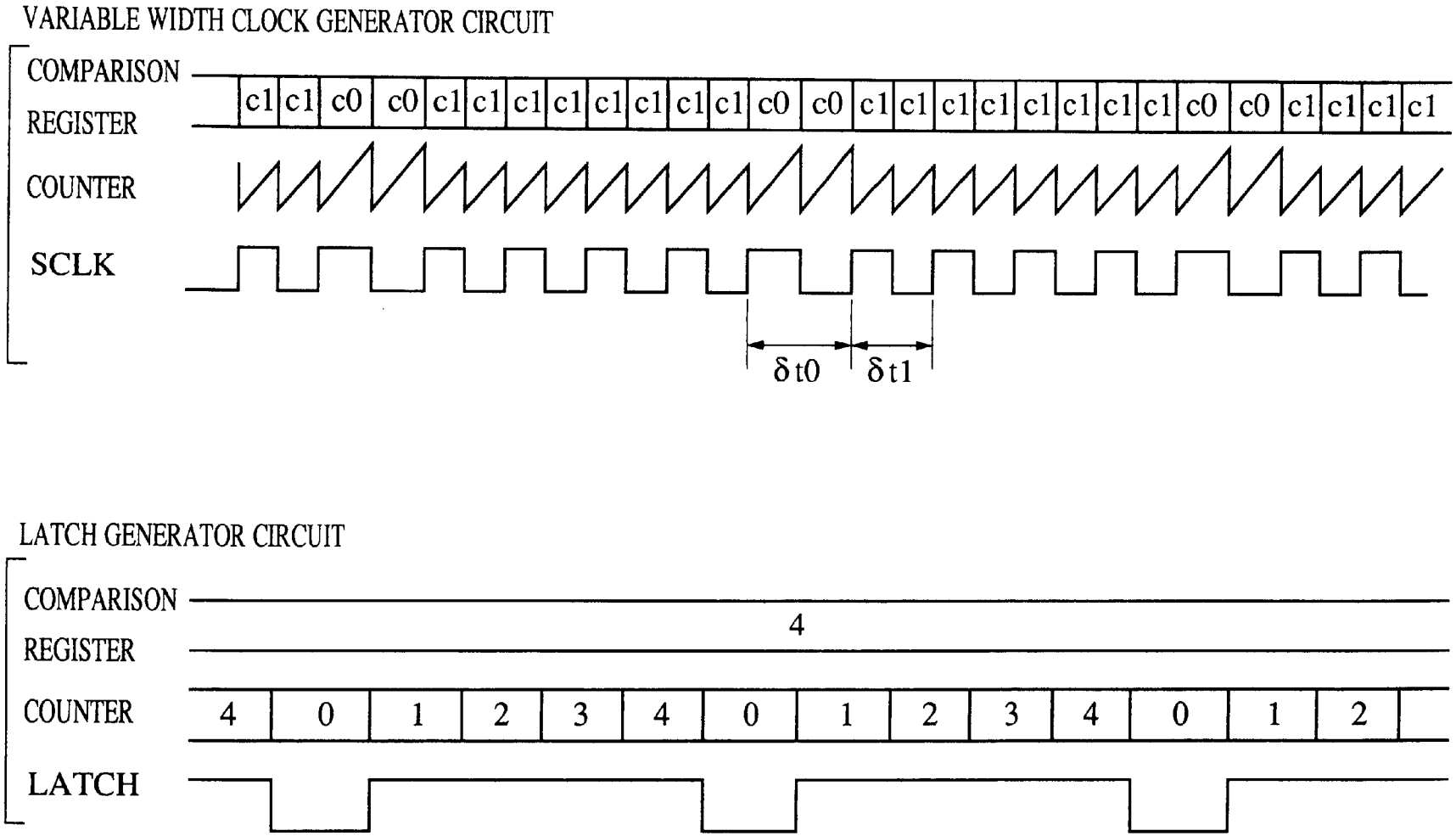
FIG. 10 is a time chart of the operation of the driver control circuit shown in FIG. 9.

A signal LATCH generator circuit 1002 counts falls of signal SCLK, resets the counter to 0 when the counted becomes equal to a value preset in a comparison register, and asserts signal LATCH as an output during the period when the value of the counter is 0. Signal LATCH is synchronized with the clock signal by a latch circuit 1008. FIG. 10 is a timing chart of the operation of the variable width clock generator circuit 1001 and the signal LATCH generator circuit 1002. In the example of the timing shown in FIG. 10, c0 cycles of the original clock are counted in a period of δt1 and c1 cycles of the original clock are counted in a period of δt0. For example, δt0=62.4 ps and δt1=52 μs are set if the frequency of the original clock distributed from the clock generator circuit 514 is 10 MHz, c0=312, and c1=260.

A drive waveform signal control circuit 1006 outputs drive waveform data stored in a scanning drive waveform register 1004 and an information drive waveform register 1005, i.e., CWFDi (i=0 to 3) and SWFDi (i=0 to 3), according to signal SCLK and signal LATCH. The outputs CWFDi and SWFDi are synchronized with the clock signal by latch circuits 1009 and 1010.

Figure 11:
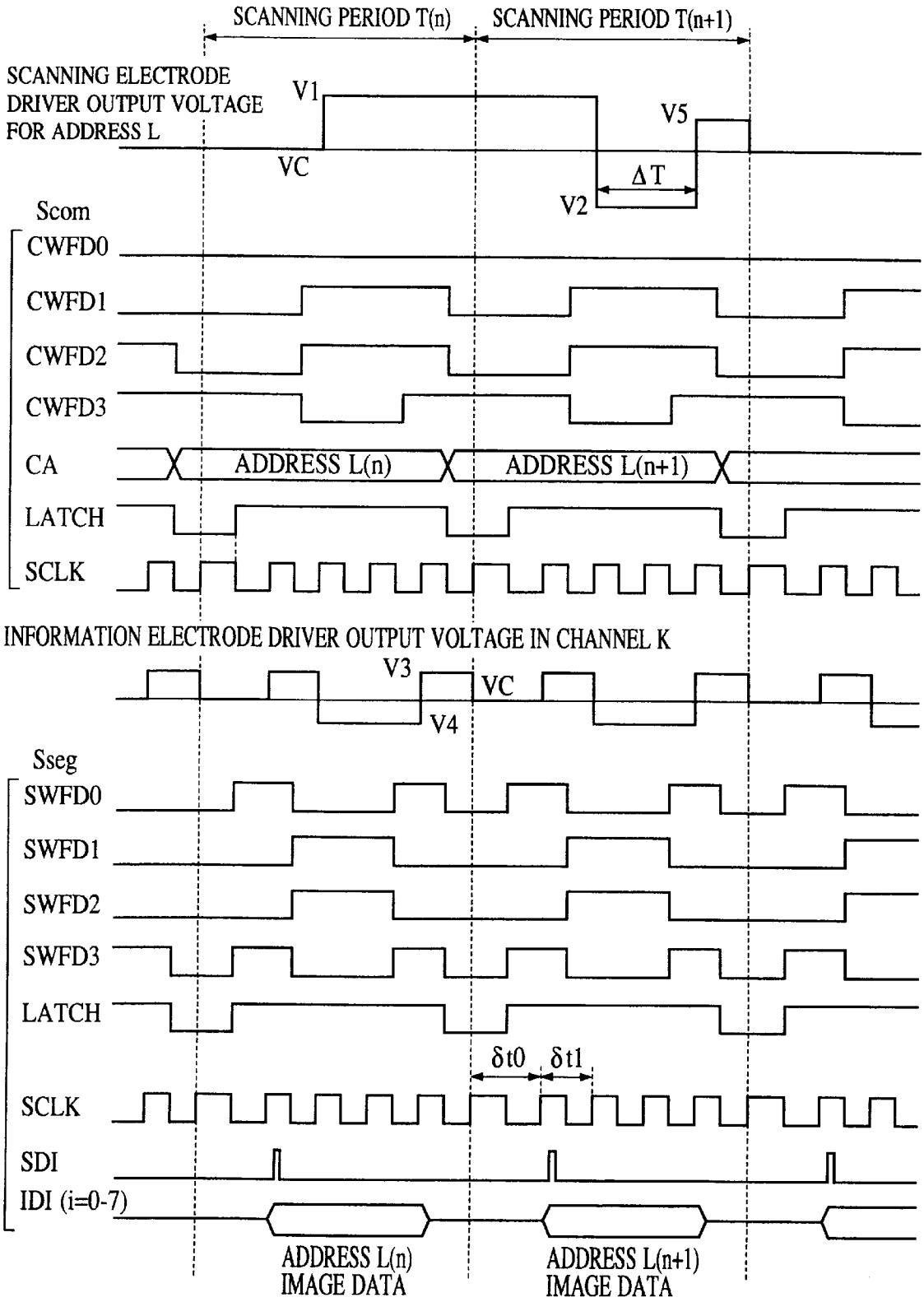
FIG. 11 is a time chart showing the relationship between signals supplied from the display control circuit to the scanning electrode driver and to the information electrode driver and output waveforms of the scanning and information signal drivers in the display device of FIG. 4.

FIG. 11 is a time chart showing the relationship between signals Scom and Sseg supplied from the display control circuit 510 to the scanning signal driver 502 and to the information signal driver 503 and the output waveforms of the scanning electrode driver 601 and the information electrode driver 602. As shown in FIG. 11, address L(n) is supplied as scanning address CA during a scanning period T(n). Each time signal SCLK rises, the scanning electrode driver 601 corresponding to address L(n) outputs the liquid crystal drive voltage according to CWFD0 and CWFD1. On the other hand, each time signal SCLK rises, each information electrode driver 602 outputs the liquid crystal drive voltage according to image data already latched by the data register 803 and SWFDi (i=0 to 3). Simultaneously, image data to be displayed at address L is transferred in synchronization with signal SDI and the transfer clock (not shown) to be stored in the data register 802.

Address L(n+1) is supplied as scanning address CA during a scanning period T(n+1). Each time signal SCLK rises, the scanning electrode driver 601 corresponding to address L(n+1) outputs the drive waveform according to SWFD0 and CWFD1 while the scanning electrode driver 601 corresponding to address L outputs the drive waveform according to CWFD2 and CWFD3, as described above. On the other hand, in each information electrode driver 602, data in the data register 802 is transferred to the data register 803 by a rise of signal SCLK during the period of assertion of signal LATCH. The liquid crystal drive voltage is output at each rise of signal SCLK according to this image data and SWFDi (i=0 to 3). Since δt0=62.4 μs and δt1=52 μs as described above with reference to FIG. 10, ΔT=104 μs and the rest period is 0.6 ΔT.

The display apparatus manufactured in accordance with this embodiment was driven by setting drive conditions: V1=14.3 V, V2=−14.3 V, V3=5.7 V, V4=−5.7 V, V5=6.4 V, VC=0 V, ΔT=104 μs, and the temperature of the liquid crystal device, 10° C. As a result, a good display could be made through the entire area of the liquid crystal display device.

An embodiment of the present invention has been described in detail with respect to an example of adjusting the clock pulse width so as to optimize the rest period provided in the information signal. However, the present invention is not limited to this example and can also be applied to adjustment of the length of any sections of the drive signal waveform, e.g., adjustment of the width of an auxiliary pulse in the information signal and the width of an auxiliary pulse in the scanning signal. The interval of pulses to be adjusted is not limited to one clock period. For example, two auxiliary pulses provided before and after an information writing pulse may be finely adjusted simultaneously and independently of each other.

According to the present invention, the width of at least one of a plurality of clock pulses supplied during one horizontal scanning period is changed substantially continuously, thus enabling each section of drive waveforms to be changed substantially continuously. Therefore, an optimal rest period can be set with respect to a drive waveform requiring a rest period without increasing the operating speed of the circuit, so that the desired range (drive margin) of selecting drive conditions can be set to achieve good display performance.

While the present invention has been described with respect to what is presently considered to be the preferred embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid crystal display apparatus comprising:

a liquid crystal display device including a first substrate and a second substrate opposed to each other, said first substrate having scanning electrodes, said second substrate having information electrodes, the scanning electrodes and the information electrodes forming a matrix electrode structure, and a liquid crystal interposed between said first and second substrates;

clock generation circuit for generating clock pulses;

scanning electrode drive means, responsive to the clock pulses, for forming a scanning signal and applying the scanning signal to one of the scanning electrodes each time one of the clock pulses is supplied from said clock generation circuit; and information electrode drive means, responsive to the clock pulses, for forming an information signal and applying the information signal to the information electrodes each time one of the clock pulses is supplied from said clock generation circuit, wherein at least one of a plurality of clock pulses supplied from said clock generation circuit in one horizontal scanning period differs in width from the others.

2. A liquid crystal display apparatus according to claim 1, wherein said clock generation circuit comprises binary signal output means, counter means for counting primary clocks supplied, hold means for holding a given reference value, and comparison means for comparing a count value of said counter means and the reference value held by said hold means, and wherein when the reference value and the count value coincide with each other, an output value of said output means is inverted to form one of the clock pulses and a new reference value is set in said hold means.

3. A liquid crystal display apparatus according to claim 1, wherein the information signal has a signal application period and a rest period, and the length of the rest period is adjusted by setting the width of the corresponding one of the clock pulses to a value different from that of the other clock pulses.

4. A liquid crystal display apparatus according to claim 1, wherein said information signal has a control pulse and an auxiliary pulse, and the width of the auxiliary pulse is adjusted by setting the width of the corresponding one of the clock pulses to a value different from that of the other clock pulses.

5. A liquid crystal display apparatus according to claim 4, wherein said information signal has two auxiliary pulses before and after the control pulse, and the widths of the two auxiliary pulse are simultaneously adjusted independently of each other.

6. A liquid crystal display apparatus according to claim 1, wherein said scanning signal has a control pulse and an auxiliary pulse, and the width of the auxiliary pulse is adjusted by setting the width of the corresponding one of the clock pulses to a value different from that of the other clock pulses.

7. A liquid crystal display apparatus according to claim 1, said liquid crystal comprises a liquid crystal having a chiral smectic phase.

8. A liquid crystal display apparatus according to claim 1, said liquid crystal comprises a ferroelectric liquid crystal.

* * * * *

UNITED STATES PATENT AND TRADEMARK OFFICE

CERTIFICATE OF CORRECTION

PATENT NO. : 6,018,330

DATED : January 25, 2000

INVENTOR(S) : TAKASHI YAMAMOTO ET AL.

It is certified that error appears in the above-identified patent and that said Letters Patent is hereby corrected as shown below:

COLUMN 1

Line 12, "Liquid" should read --liquid--.

COLUMN 2

Line 7, "provide" should read --provide the--.

COLUMN 5

Line 3, "ps" should read --$\mu$s--.

COLUMN 7

Line 7, "pulse" should read --pulses--.

Signed and Sealed this

Third Day of April, 2001

Nicholas P. Godici

*Attest:*

NICHOLAS P. GODICI

*Attesting Officer*

*Acting Director of the United States Patent and Trademark Office*